US005669116A

United States Patent [19]

Jungkind

[11] Patent Number: 5,669,116

[45] Date of Patent: Sep. 23, 1997

[54] SHOE CLOSURE

[75] Inventor: Roland Jungkind, Garmisch-Partenkirchen, Germany

[73] Assignee: Puma AG Rudolf Dassler Sport, Herzogenaurach, Germany

[21] Appl. No.: 549,707

[22] PCT Filed: Dec. 27, 1993

[86] PCT No.: PCT/DE93/01250

§ 371 Date: Nov. 15, 1995

§ 102(e) Date: Nov. 15, 1995

[87] PCT Pub. No.: WO94/26138

PCT Pub. Date: Nov. 24, 1994

[30] Foreign Application Priority Data

May 15, 1993 [DE] Germany ..... 43 16 340.8
Aug. 14, 1993 [DE] Germany ..... 93 12 197 U

[51] Int. Cl.[6] ..... A43C 11/00

[52] U.S. Cl. ..... 24/68 SK; 24/69 SK; 24/70 SK

[58] Field of Search ..... 24/68 SK, 69 SK, 24/70 SK, 71 SK

[56] References Cited

U.S. PATENT DOCUMENTS 4,660,300 4/1987 Morell et al. ..... 24/68 SK
4,826,098 5/1989 Pozzobon et al. ..... 24/68 SK
5,152,038 10/1992 Schoch ..... 24/68 SK
5,157,813 10/1992 Carroll ..... 24/68 SK

FOREIGN PATENT DOCUMENTS 0255869 2/1988 European Pat. Off. .
0297342 1/1989 European Pat. Off. .
4240916 10/1993 Germany .

*Primary Examiner*—Victor N. Sakran
*Attorney, Agent, or Firm*—Sixbey, Friedman, Leedom, & Ferguson, PC.; David S. Safran

[57] ABSTRACT

A shoe fastener with a rotary actuating element (35) that has a pulley (3) coupled thereto via a self-locking reduction gear which is in the form of an eccentric drive (10, 12). An unwinding gear is pivotally mounted in a housing (1) of the fastener and is formed of a disk (24) having a grooved outer catch rim (26). The unwinding gear can be fixed in any of several angular positions via a catch element (42) which can be released via a tension element (47) which, at the same time, can be used to pull open the shoe by lifting of a tongue or instep cover (55) of the shoe upon which the fastener is mounted.

13 Claims, 3 Drawing Sheets

SHOE CLOSURE

BACKGROUND OF THE INVENTION

1. Field of the Invention

This invention relates to a shoe fastener which can be actuated via a rotary element with a pulley pivotally mounted in a bearing element coaxially with respect to a central axis of the rotary element for winding at least one cable-like tension element, a reducing gear between the rotary element and the pulley in the form of an eccentric drive in which an external unwinding gear is pivotally mounted in a housing of the shoe closure and which is securable in each of several angular positions.

Such a shoe fastener, with an eccentric gear mechanism, is described in my German patent DE 42 40 916 C1. The outer unwinding toothed wheel is pivoted there in the housing and can be fixed in position by one or more grooves on the circumference.

2. Description of Related Art

Other shoe fasteners are also known, for example from EP 255 869 A2, in which the rope pulley is pivoted in a housing on a stationary steering pivot pin and is driven like a Geneva movement or a planetary gear. The top side of the housing cover is provided with an annular gear which, together with a catch that can be actuated by the turning component, forms a catch device that catches in the closing direction. The turning component has a driving peg that engages in an arc-shaped recess in a washer. The recess extends over a small angle sector so that the turning component is freely movable, relative to the washer, by a small angle of rotation of, for example, 30°.

The catch is elastically prestressed on the washer so that a projecting tooth engages in the annular gear and another projecting tooth located on the opposite side engages in another arc-shaped steering recess of the turning component. The steering recess is cut free on one end so that, when the turning component turns in the closing direction, the engaging projecting tooth remains freely movable. When the mining component turns in the closing direction, and after the driving peg strikes within an allocated recess, the washer is also moved. Thus the catch is moved by the annular gear and in doing so catches, by slanted sides, from one tooth to the next.

When the turning component turns in the opening direction, it turns, relative to the washer, according to the clearance angle defined by the recess. In doing so, a ramp-like, rising control surface present on the other end of the steering recess presses the catch, by the allocated projecting tooth, and the catch thus is moved out of the radius of action of the annular gear. Thus the possibility of locking is eliminated and the turning knob can be turned in the opening direction and the rope pulley can be turned, by the gear mechanism, in the unwinding direction. A quick opening of the shoe fastener is thus not possible, despite the relatively expensive construction of the shoe fastener.

Further, shoe fasteners with a turning component are known that have a planetary gear. With these fasteners, a quick disengagement is possible in that, by pressure on the center of the turning knob in the direction of the central axis, the gear mechanism is decoupled from the rope wheel, so that the rope wheel can be freely turned.

SUMMARY OF THE INVENTION

In contrast, with this invention the object to be achieved is to configure a shoe fastener of the above-mentioned type so that a quick disengagement of the shoe fastener and the opening of the shoe with a single actuation component can be performed almost simultaneously.

This object is achieved by the following features:

(a) the unwinding gear is formed of a disk having a grooved outer catch rim;

(b) a catch element is supported outside of the action range of the unwinding gear disk and is deflectable transversely with respect to the central axis;

(c) the catch element is elastically pretensioned by a tension element such that a catch component of the catch element, which points towards the outer catch rim, elastically latches into a groove of the outer catch rim;

(d) the catch element has at least one release arm;

(e) the release arm is coupled to the tension element and can be actuated from the outside for disengaging the catch component from the catch rim;

(f) there is a shoe closure on a shoe part which can move in an opening direction when the shoe is opened; and (g) the shoe closure can be moved together with the shoe part in the shoe opening direction via the tension element.

In contrast to known quick releases by pressure on a central part of the rotary element, in the quick release design according to the invention the shoe closure can be pulled via the tension element in the shoe opening direction at the same time with its base.

From EP-A-0 297 342 A2 a shoe closure is known which can be actuated by a rotary member, in which a catch element is supported to deflect transversely to the central axis. The catch element can be swivelled in the unlock direction by a lever swivel mounted on the closure via a push button which projects laterally from the closure and which is provided on the lever. However as the drive for the pulley there is a spur gear there which is not self-locking for the multiplication used there. The catch element is therefore necessary in order to be able to maintain a tensioned state when the shoe is closed. For this reason the catch element interacts with ratchet teeth which is present on the bottom of the pulley, so that the pulley can be turned in the tension direction, but not in the release direction. For quick release the catch lever can be swivelled out of a area of the ratchet teeth via the push button, by which the spur gear can then turn freely. To open the shoe therefore both the push button must be pressed and at the same time the shoe opened for example by pulling on the tongue or on the top material. When this known ratchet interlock is used on a pulley driven by a cam drive releasing the catch element would have no effect at all, since the cam drive is self-locking even at a small multiplication ratio. Quick release must therefore be done differently when using a cam drive. One advantageous solution of this problem is achieved by this invention.

Other advantageous details of the invention are given in the subclaims and are detailed below using the embodiments shown in the drawing.

DETAILED DESCRIPTION OF THE PREFERRED EMBODIMENTS

Figure 1:
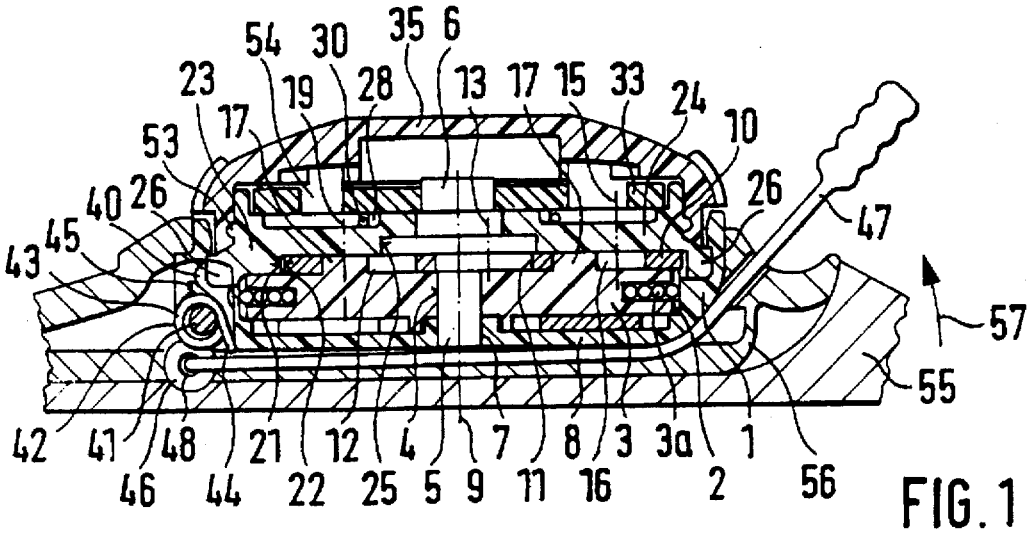
FIG. 1 shows a cross section through a shoe closure with a cam drive as the reducing gear in the locked state.
Figure 2:
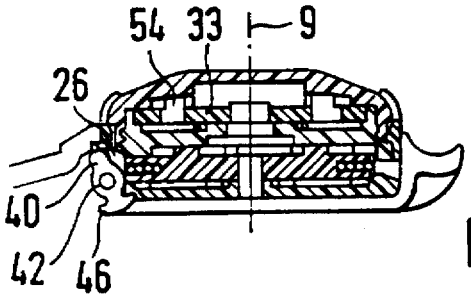
FIG. 2 shows the same shoe closure in the unlocked state.

The shoe fastener according to the invention has, according to FIGS. 1 and 2, a housing part 1 that has a circular recess 2 to receive a rope pulley 3 and ropelike tightening component(s) 3*a*. The insertion of ropelike tightening component(s) 3*a* into rope pulley 3 is performed by guide mechanisms, known in the art, in housing part 1. Rope pulley 3 has a centered hole 4 through which a bearing neck 5 of an axle unit 6 engages and ends in a bearing hole 7 of bottom 8 of housing part 1. The axle of bearing neck 5 simultaneously forms central axis 9 of the shoe fastener.

An eccentric drive pulley 10 lies on rope pulley 3. The former has a central bearing hole 11 with which it is pivoted on an eccentric drive pin 12, placed eccentrically to central axis 9, of axle unit 6. In each case there lies, on a circle that is concentric to central axis 13 of eccentric drive pin 12, center point 15 of several, six here in the embodiment, circle sectors 16, in each of which one coupling pin 17 of rope pulley 3 engages. The angular position of circle sectors 16 corresponds to those of coupling pins 17. Preferably, circle sectors 16 are each mutually offset by the same angle, by 60° in the embodiment. Basically, a single circle sector 16, operationally connected to only one coupling pin 17, would also be sufficient.

By turning axle unit 6 around central axis 9, center axis 13 of eccentric drive pin 12 describes a concentric orbit to central axis 9. Center points 19 of coupling pins 17 lie on a center circle that is concentric to central axis 9.

The outer contour of eccentric drive pulley 10 has teeth 21 that can roll on an inner contour, made as counterteeth 22, of a collar 23, which projects downward on one side, of a pulley 24 that covers eccentric drive pulley 10 and is made as a winding toothed wheel. Pulley 24 has a central hole 25 with which the pulley is pivoted on axle unit 6, concentric to central axis 9. Pulley 24 further has an outer catch rim 26 made as an outer toothed rim, in which a catch component 40 in the form of a catch finger of a catch element 42, for example a catch bar or another suitable catch element, pivoted on a pivot pin 41, engages. Preferably, a spring with two, preferably tangentially projecting spring parts 44, 45 and made as a coil spring 43 is put on same pivot pin 41. One projecting spring part 45 presses, with pretensioning, against catch component 40 and presses it into a groove of outer catch rim 26 and thus can lock the winding toothed wheel or pulley 24 in all the angular positions predetermined by the teeth.

Attached to a freely projecting disengagement arm 46 is a pulling element 47 that can be actuated from the outside and by which catch element 42 can be pulled against the spring force of spring 43 into the disengagement on freely projecting release arm 46 tension element 47 is attached which can be actuated from the outside and via which catch element 42 can be pulled in the release direction against the spring force of spring 43.

Attachment of tension element 47 to catch element 42 can take place via hole 48 which is provided in release arm 46 and in which tension element 47 which consists for example of spring steel wire is suspended with a bent hook or is attached in some other way.

Figure 4:
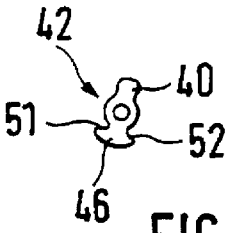
FIGS. 3 and 4 show two different embodiments of the catch element.
Figure 5:
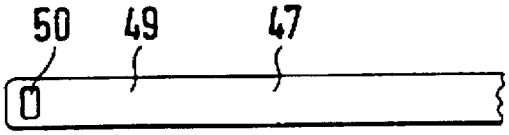
FIG. 5 shows the end section of a pull strap.

According to FIGS. 2, 4 and 5 tension element 47 can be formed at least on inner end 49 as a pull strip. For its attachment on catch element 42 it has recess or opening 50 with which it is suspended in a hook or at least in one retaining finger 51 or in two retaining fingers 51, 52 of release arm 46. Opening 50 is advantageously made as a slot which runs transversely to the tension direction in the ready-to-operate state. Its length and width are such that tension element 47 in a direction transverse to the pull direction is inserted via retaining finger(s) 51, 52 and the position is fixed after swivelling into the tension direction.

Disk 24 has on the side opposite collar 23 another collar which projects upward. By means of its outline the latter forms catch rim 28 against which catch spring 30 rests in an elastic and locking manner. Catch spring 30 is attached for its part in a suitable manner to rotary element 33 which overlaps disk 24. Rotary element 33 is connected to axis unit 6 or forms a structural unit with it. Rotary element 33 is provided with a preferably elastic cover cap 35 which preferably coupled, for example by connecting pegs 54, to turning component 33.

The shoe fastener can be attached to an instep covering 55, for example to an inner tongue of a shoe or to a tongue covering the shoe from the outside or to a holding part 56, attached to the latter tongue, for the shoe fastener.

The shoe fastener works in the following way:

The shoe fastener is in the locked position represented in FIG. 1 in which tightening element 3*a* can be still further pulled.

When covering cap 35 is turned, turning component 33 and, with it, axle unit 6, are turned by connecting pegs 54 in the tightening direction, for example clockwise.

Since pulley 24 is secured against twisting by catch component 40, it remains in the fixed position. By eccentric drive pin 12, eccentric drive pulley 10 is also moved and rolls with its teeth 21 on counterteeth 22 with reduced speed.

When eccentric drive pulley 10 is turned, rope pulley 3 is also turned by coupling pins 17, and circle sectors 16 move in a circle around coupling pins 17. In doing so, tightening element 3*a* is wound on rope pulley 3.

For quick disengagement, when pulling element 47 is pulled, catch element 42 is pivoted into the disengagement direction. In doing so, catch component 40 becomes disengaged from outer catch rim 26. In this way, pulley 24 can be freely turned in housing part 1 and, with it, rope pulley 3. The eccentric gear mechanism remains here in the locked position, so that all driving parts also turn.

Simultaneously, when pulling element 47 is pulled, the entire shoe fastener and, with it, its support, on which it is attached, i.e., the tongue or instep cover 55 of the shoe, is raised in the direction of arrow 57 and simultaneously thus the shoe is opened.

Figure 3:
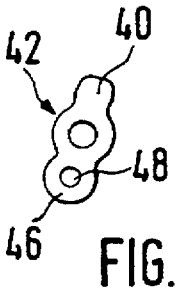
Figure 6:
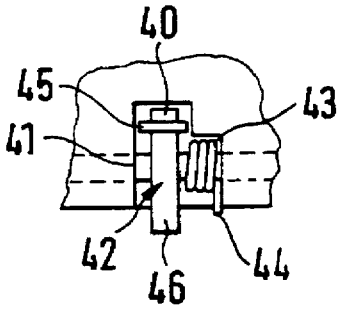
FIG. 6 shows an individual view of the spring arrangement.

The disengagement position of catch component 40 is represented in FIG. 2, and, as catch element 42, one with suspending fingers 51 and 52 according to FIG. 4 is used, while in FIG. 1 a catch element 42 with a hole 48 according to FIG. 3 is represented.

After releasing pulling element 47, catch component 40 engages in a toothed groove of outer catch rim 26. Thus pulley 24 is again secured against twisting and the closing procedure can again be performed.

Figure 7:
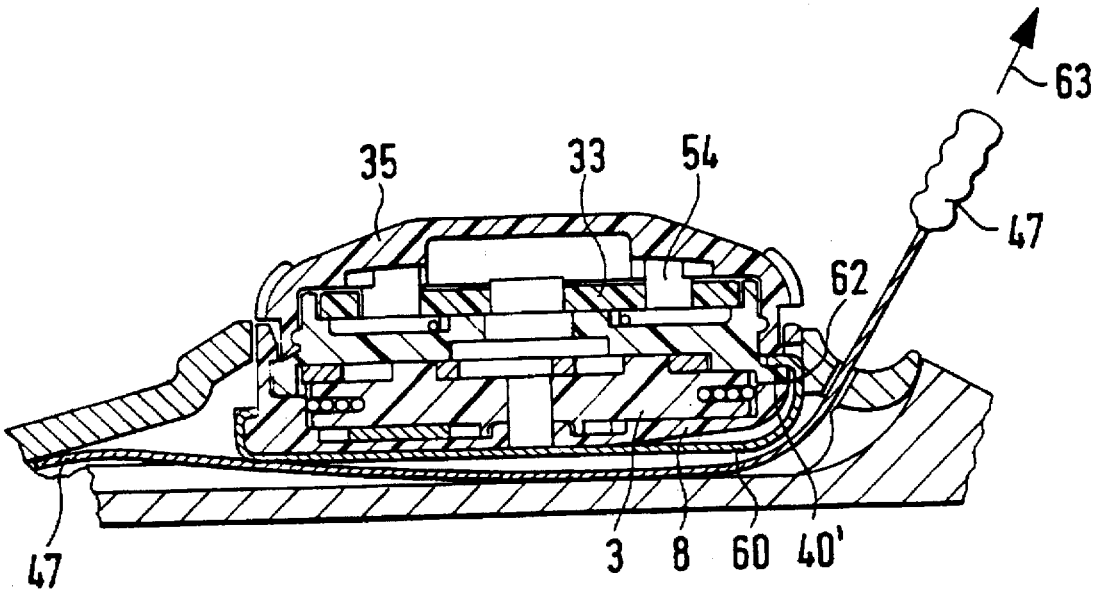
FIG. 7 shows a cross section as in FIG. 1 but with another embodiment of a catch means.
Figure 8:
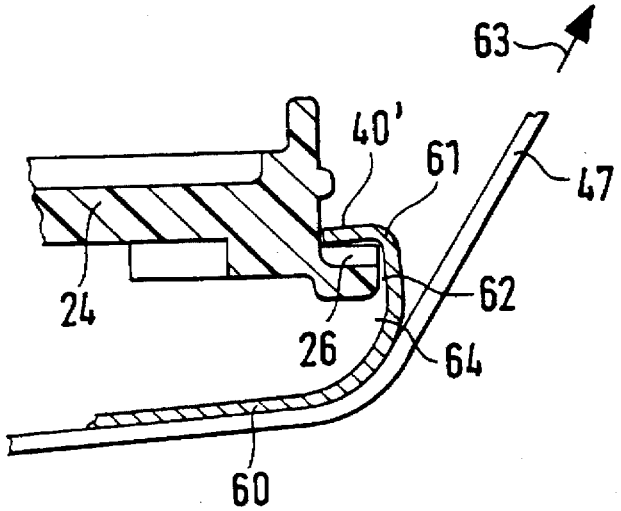
FIG. 8 shows an enlarged view of the section of the shoe closure of FIG. 7 which is located in the circle.
Figure 9:
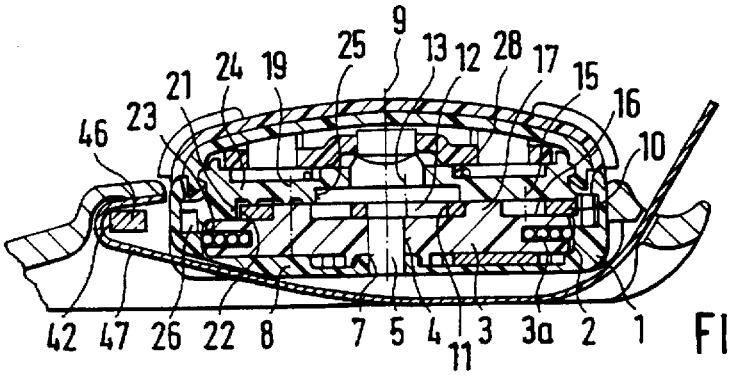
FIG. 9 shows a cross section through a shoe fastener with an eccentric gear mechanism in the engaged state and with another possibility of the drawstring arrangement.
Figure 10:
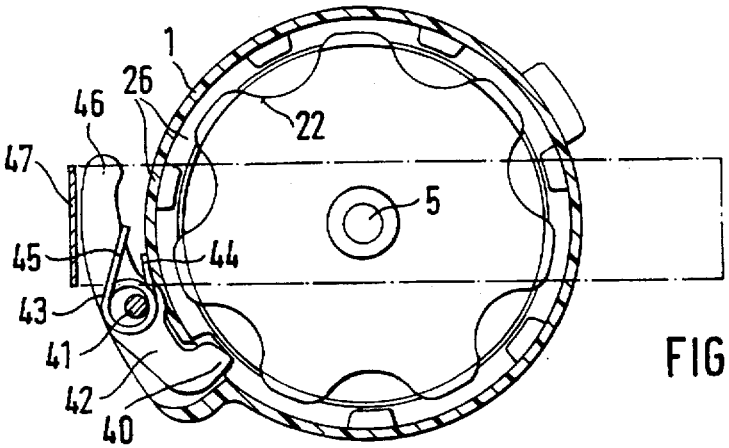
FIG. 10 shows a top view of the shoe fastener according to FIG. 9, in section, in the engaged state, and the engagement is visible by leaving out the gear parts.
Figure 11:
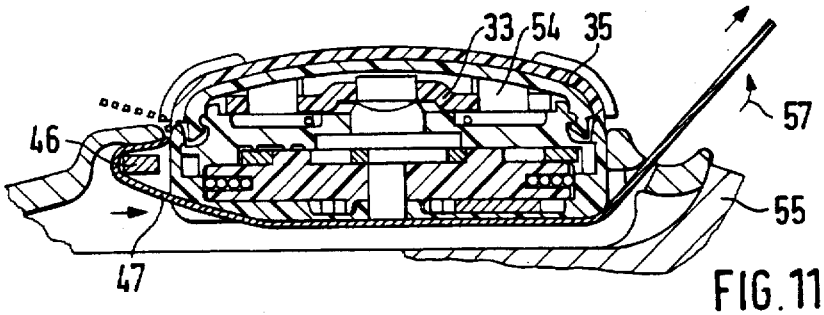
FIG. 11 shows a cross section similar to that of FIG. 9, but in the disengaged state.
Figure 12:
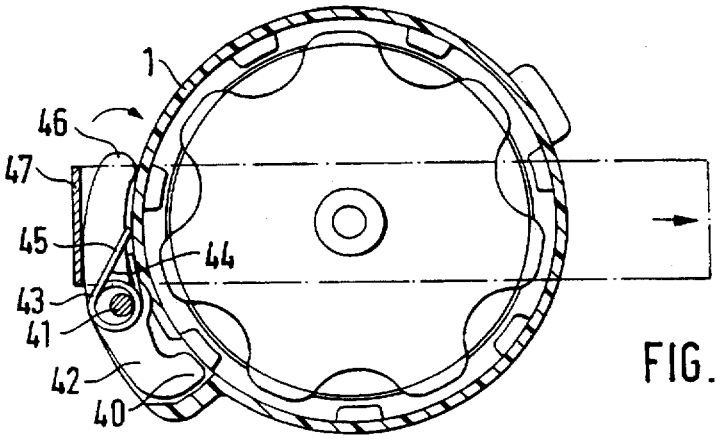
FIG. 12 shows a top view of the shoe fastener according to FIGS. 9 and 10 each in the disengaged state.

In the additional embodiment of this invention represented in FIGS. 7 and 8, the catch element is made as a catch spring 60, for example made of an elastic wire or strip stock made of steel, special steel, spring bronze, elastically springy plastic, or the like. Catch spring 60 is mounted on one side, for example under bottom 8 of the shoe fastener, or attached there in another way. Catch spring 60 engages, with its end section 61 made as hook-shaped catch component 40', from underneath around edge 62 of outer catch rim 26 and engages, with its own pretensioning, from above in the groove of the teeth of outer catch rim 26.

Pulling element 47 attached on the shoe, for example on the tongue, on bottom 8, or on catch spring 60, runs, at least in end section 61, under catch spring 60. When pulling element 47 is pulled in the direction of arrow 63, catch spring 60 or its end section 61 is raised upward because of play 64 present there and thus catch component 40' is disengaged from outer catch rim 26. Thus the quick disengagement of the shoe fastener and the opening of the shoe with a short pull on pulling element 47 is made possible.

After releasing pulling element 47, catch component 40' automatically catches in one of the grooves of outer catch rim 26 and the shoe can again be closed.

In the embodiment represented in FIGS. 9 to 12, drawstring 47 that can be actuated from the outside also engages in freely projecting disengagement ann 46 of catch element 42. In doing so, catch element 42 can be deflected crosswise to central axis 9 in such a way that its pivot pin 41 is placed running parallel to central axis 9. In this way, a flat construction of the central turning fastener is possible. Pulling element 47 is guided upward here on the shoe closure, on the side facing away from the shoe tip, out of the shoe fastener, and is made there for example as a looped handle. From there, drawstring 47 runs directly under housing 1 or in a special guide mechanism or in a guide channel of it, forward toward the shoe tip and there is wound by about 180° around disengagement arm 46 and then attached to the fastener or to a shoe part. After winding around disengagement arm 46, drawstring 47 can be wound by about 180° forward around a fastening part or around a shoe part and be attached on the shoe in the area of the shoe tip or of the tongue base, on the tongue or on an instep part, as shown in dashed lines in FIG. 11.

The way in which this shoe fastener works is essentially the same as was already explained based on the above-described embodiment.

I claim:

1. Shoe fastener mounted on a part of a shoe upper which can move in an opening direction for opening of the shoe, comprising a rotary actuating element, a winding pulley pivotally mounted on a bearing element coaxially with respect to a central axis of the rotary actuating element for winding at least one cable-like tension element thereon, a reducing gear between the rotary actuating element and the winding pulley in the form of an eccentric drive in which an external unwinding gear is pivotally mounted in a housing of the shoe closure and means for fixing the unwinding gear in each of several angular positions thereof;

wherein:

the unwinding gear is in the form of a disk having a grooved outer catch rim;

the means for fixing comprises a catch element with a catch component pointed towards the outer catch rim, the catch element being supported outwardly of the unwinding gear disk in a manner enabling the catch component to deflect transversely with respect to the central axis of the rotary actuating element, the catch element being elastically pretensioned by a tension element in a direction causing the catch component to elastically latch into a groove of the outer catch rim;

an externally actuatable release element is arranged to act against the pretension of the tension element as a means for disengaging the catch component from the groove of the external catch rim; and the release element forms a means for moving the shoe fastener together with said part of the shoe upper on which it is mounted in a shoe opening direction.

2. Shoe fastener according to claim 1, wherein the catch element is supported on a pivot pin; and wherein the pivot axis extends crosswise to said central axis of the rotary actuating element.

3. Shoe fastener according to claim 2, wherein the pivot pin is perpendicular to said central axis of the rotary actuating element and is tangential with respect to a circular plane perpendicular to said central axis.

4. Shoe fastener according to claim 2, wherein the pivot pin (41) is placed parallel to central axis (41).

5. Shoe fastener according to claim 1, wherein the tension element by which the catch element is pretensioned comprises a spring; and wherein the release element comprises a pulling element which interacts with a freely projecting disengagement arm of the catch element.

6. Shoe fastener according to claim 5, wherein the disengagement arm has a recess or hole in which the pulling element is engaged.

7. Shoe fastener according to claim 5, wherein the pulling element has a recess or perforation in which the disengagement arm is engaged.

8. Shoe fastener according to claim 7, wherein the disengagement arm has at least one laterally projecting suspending finger and a slit running perpendicular to a longitudinal direction of said at least one suspending finger being provided in the pulling element, said slit having a length which enables the pulling element fixed on said at least one suspending finger with the slot running in a direction running crosswise to a pulling direction.

9. Shoe fastener according to claim 5, wherein the pulling element comprises a drawstring which is guided from a free end portion thereof which extends out of the fastener at a side thereof which is opposite a toe end of the shoe, under the fastener forward toward the toe end of the shoe, passing about 180° around the disengagement arm and to a point where the drawstring is attached to a part of the fastener or the shoe.

10. Shoe fastener according to claim 9, wherein the drawstring, after being wound around the disengagement arm, is wound around said part of the fastener or the shoe by about 180° to said point where it is attached which is an area of one of the toe end of the shoe tip, a base of a tongue, the tongue, and an instep part.

11. Shoe fastener according to claim 1, wherein the part of the shoe on which the fastener is mounted is one of an instep covering and a tongue of the shoe and is movable therewith in the shoe opening direction.

12. Shoe fastener mounted on a part of a shoe upper which can move in an opening direction for opening of the shoe, comprising a rotary actuating element, a winding pulley pivotally mounted on a bearing element coaxially with respect to a central axis of the rotary actuating element for winding at least one cable-like tension element thereon, a reducing gear between the rotary actuating element and the winding pulley in the form of an eccentric drive in which an external unwinding gear is pivotally mounted in a housing of the shoe closure, and means for fixing the unwinding gear in each of several angular positions thereof;

wherein:

the unwinding gear is in the form of a disk having a grooved outer catch rim;

the means for fixing comprises a catch element with a catch component pointed towards the outer catch rim, the catch element being supported outwardly of the unwinding gear disk in a manner enabling the catch component to deflect transversely with respect to the central axis of the rotary actuating element, the catch element being elastically pretensioned by a tension element in a direction causing the catch component to elastically latch into a groove of the outer catch rim;

an externally actuatable release element is arranged to act against the pretension of the tension element as a means for disengaging the catch component from the groove of the external catch rim; and the release element forms a means for moving the shoe fastener together with said part of the shoe upper on which it is mounted in a shoe opening direction; wherein the catch element and the tension element are formed by a catch spring provided with said catch component as part thereof; and wherein the release element comprises a pulling element by which the catch component of the catch spring is displaceable against the pretensioning of catch spring into a disengaged position.

13. Shoe fastener according to claim 12, wherein the catch component of the catch spring is hook-shaped curving upward from underneath the unwinding gear to above the outer catch rim, the catch component being upwardly movable by said pulling element.

* * * * *